US005162803A

United States Patent [19]

Chen

[11] Patent Number: 5,162,803

[45] Date of Patent: Nov. 10, 1992

[54] BEAMFORMING STRUCTURE FOR MODULAR PHASED ARRAY ANTENNAS

[75] Inventor: Chao C. Chen, Torrance, Calif.

[73] Assignee: TRW Inc., Redondo Beach, Calif.

[21] Appl. No.: 702,470

[22] Filed: May 20, 1991

[51] Int. Cl.[5] ..... H01Q 3/22; H01Q 3/24; H01Q 3/26

[52] U.S. Cl. ..... 342/372; 342/375

[58] Field of Search ..... 342/375, 376, 372, 368; 343/771, 776, 777, 778; 333/157

[56] References Cited

U.S. PATENT DOCUMENTS 3,718,933 2/1973 Huele .
3,766,558 10/1973 Kuechken .

*Primary Examiner*—Theodore M. Blum
*Attorney, Agent, or Firm*—Noel F. Heal; Ronald L. Taylor

[57] ABSTRACT

A combination of doubly folded parallel plate beam combiners or dividers, configured to produce a desired composite beam for use in arrays of antenna elements. The doubly folded combiner or divider functions to expand a transmitted beam, or contract a received beam, in one selected plane. In a transmit mode, a single beam can be expanded first in one direction by a first divider, then expanded in a perpendicular direction by a stack of additional dividers coupled to the first. Optional phase shifting circuits provide beam steering as desired. Second and other additional beams can be processed in the same manner, to produce a composite output of multiple beams for transmission by an antenna array. Another aspect of the invention involves the use of a beam forming structure of this type in conjunction with an array of transmit/receive microwave modules providing amplification and phase shifting functions, and an array of printed circuit antenna elements. With appropriate phase shifting controls, a composite beam transmitted or received by the array or antenna elements can be steered independently in azimuth and elevation, using much less complex control circuitry than a conventional phased array antenna system.

13 Claims, 8 Drawing Sheets

BEAMFORMING STRUCTURE FOR MODULAR PHASED ARRAY ANTENNAS

BACKGROUND OF THE INVENTION

This invention relates generally to microwave antenna structures and, more particularly, to phased array antennas requiring a large number of power combiners or dividers. Microwave power combiners and dividers using hybrid techniques are difficult to design and construct, as well as being heavy and relatively costly. Microstrip or stripline power combiners are too lossy in the millimeter-wave frequency range, and additional amplifiers are often needed for compensation. The addition of these amplifiers not only increases the system complexity and cost, but also lowers the manufacturing yield, increases heat losses, and reduces system reliability. Therefore, there is a need for a simpler, more reliable, and less costly technique for combining and dividing microwave power in a beamforming antenna structure.

A related problem in the phased array antenna field is a difficulty that exists in constructing a phased array antenna system in the millimeter-wave frequency range. Such structures have been impractical because of system complexity and cost. A high-gain phased array requires a large number of microwave feeds, beam steering electronics, and labor-intensive manufacturing and testing. Moreover, even if these difficulties can be overcome the resulting device consumes excessive power and produces intolerable heat, due to low receiver or transmitter efficiency. Components and devices have been successfully developed for operation in the X-band and Ku-band of frequencies, which fall into the centimeter-wave or supra-high frequency (SHF) range. However, attempts to scale these for operation in the extra-high frequency (EHF) or millimeter-wave range have not been fruitful because of intolerably high radio-frequency (rf) losses, and difficulties in manufacturing precision and packaging. Therefore, there is still a need for improvement in the technology used for millimeter-wave phased arrays.

SUMMARY OF THE INVENTION

The present invention resides in a combination of doubly folded parallel plate radio frequency (rf) power combiners or dividers, producing a composite beam that is expanded in two cross-sectional dimensions, and is steerable as desired using phase shifting circuitry. Another aspect of the invention lies in a complete phased array antenna system, including a beam forming structure using combinations of doubly folded power combiners or dividers, an array of transmit/receive microwave modules, and an array of antenna elements.

Briefly, and in general terms, the invention comprises a doubly folded parallel plate beam combiner/divider, having a first port for a radio-frequency (rf) signal that has been received or is to be transmitted, and has a second port with an aperture that is elongated along a first direction; and a stack of identical doubly folded parallel plate beam combiners/dividers, each of which has a first port coupled to the second port of the first beam divider, and has a second port that is enlarged along a second direction approximately perpendicular to the first direction, whereby the combined second ports of the stack of beam combiners/dividers receive or transmit a composite beam that is enlarged in cross section in two perpendicular dimensions. The invention may also include a plurality of phase shifting circuits, each associated with one of the stack of beam dividers, for scanning the composite beam in a plane parallel to the first direction.

It will be understood that the combiner/dividers function as power dividers in a transmit mode of operation, and as power combiners in a receive mode of operation.

In one form of the invention, the combination further comprises at least one additional power divider aligned in the first direction, wherein both of the dividers aligned in the first direction have two rf input feeds. Each of the stack of dividers aligned in the second direction also has two rf inputs. The outputs of one of the dividers aligned in the first direction are coupled to a first rf input of each of the dividers aligned in the second direction, and the outputs of the other of the dividers aligned in the first direction are coupled to a second rf input of each of the dividers aligned in the second direction. In this way at least two composite beams are output from the stack of dividers aligned in the second direction.

A phased array antenna system in accordance with the invention comprises a doubly folded parallel plate beam combiner/divider, having a first port for a radio-frequency (rf) signal that has been received or is to be transmitted, and has a second port with an aperture that is elongated along a first direction; a stack of identical doubly folded parallel plate beam combiners/dividers, each of which has a first port coupled to the second port of the first beam divider, and has a second port that is enlarged along a second direction approximately perpendicular to the first direction; a plurality of phase shifting circuits coupled to the first ports of the stack of combiner/dividers, for varying the phase of rf signals transmitted through the first ports of the stack of combiner/dividers; a plurality of microwave transmit/-receive modules arranged in an array with multiple rows and columns, and coupled to the second ports of the stack of combiner/dividers, wherein each row of modules is coupled to one of the second ports, and wherein each module includes a phase shifting circuit; and an array of antenna elements, each coupled to one of the transmit/receive modules, to receive or transmit a composite beam. The plurality of phase shifting circuits coupled to the first ports of the stack of combiner/dividers are adjustable to steer the composite beam in a plane parallel to the first direction, and the phase shifting circuits include in the transmit/receive modules are adjustable to steer the composite beam in a plane parallel to the second direction.

More specifically, each of the transmit/receive modules includes an rf amplifier, first coupling means, for coupling a corresponding antenna element to the rf amplifier, and second coupling means, for coupling the phase shifting circuit to the second port of one of the stack of combiner/dividers. Further, the phase shifting circuit included in each transmit/receive circuit includes multiple phase shifting units, each of which can be selectively enabled to interpose a phase shift of a fixed amount. The second coupling means includes a microwave transition section for converting from a slotline configuration to a waveguide configuration and vice versa, and this transition section may be either a tapered slotline transition or a finline transition.

The structure of the doubly folded parallel plate combiner/divider in the present invention includes a feed horn coupled to the first port, a convex subreflector, a concave main reflector, a first planar waveguide section extending from the feed horn to the subreflector and presenting a diverging path as viewed from the feed horn, a second planar waveguide section extending from the subreflector to the main reflector, overlaying the first planar waveguide section, and presenting a further diverging and unobstructed path as viewed from the subreflector, and a third planar waveguide section. The third planar waveguide section extends from the main reflector to the second port, overlaying the second planar waveguide section, and providing an unobstructed path to the second port, which has an aperture expanded in a direction parallel to the plane of the combiner/divider.

It will be appreciated from the foregoing that the present invention represents a significant advance in the field of phased array antenna systems. In particular, the invention provides a novel arrangement of structural modules that facilitate construction and operation of a phased array antenna system. The basic structural module is the doubly folded parallel plate power combiner or divider. Moreover combinations of these power combiners or dividers with microwave circuit modules for amplification and phase control together with arrays of printed circuit antennas elements, provide a highly efficient approach to the design and construction of phased array antenna systems. Other aspects and advantages of the invention will become apparent from the following more detailed description, taken in conjunction with the accompanying drawings.

DESCRIPTION OF THE PREFERRED EMBODIMENTS

Figure 1:
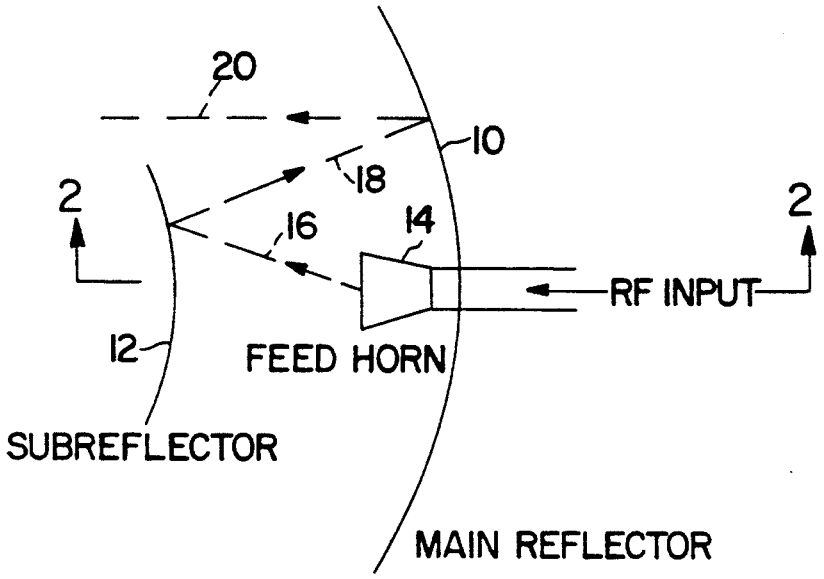
FIG. 1 is a diagrammatic top view of a parallel plate power combiner or divider used in the present invention.

As shown in the drawings for purposes of illustration, the present invention is concerned with improvements in beamforming structures for phased array antennas. As is well known, arrays of antenna elements can be electronically steered by subjecting a transmitted or received signal to appropriate phase delays. Although the theory of such systems is well known, their complexity and high cost have severely limited their use.

Inherently, phased arrays require power combining or dividing devices, to split a transmitted beam into an array of beams of which the phase can be independently controlled. Hybrid power combiners are costly and heavy, and power combiners using microstrip or stripline construction have high loses in the millimeter-wave range of frequencies.

In accordance with one aspect of the invention, a fundamental module for constructing beamforming networks and phased array antenna systems is doubly folded parallel plate power combiner or divider. This device may be referred to as a combiner, a divider, or a combiner/divider. It will be understood that the same device performs either a power combining or a power dividing function.

Figure 2:
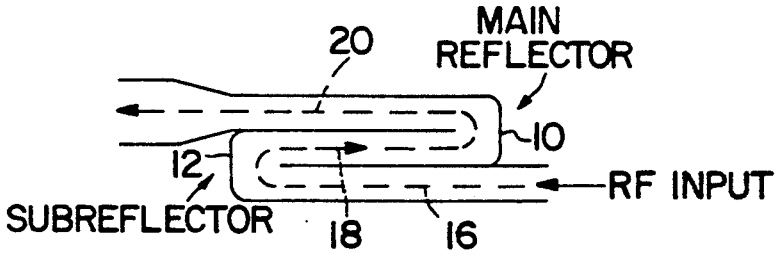
FIG. 2 is a cross-sectional view of the combiner/divider, taken substantially along the ling 2—2 in FIG. 1.

As shown in FIGS. 1 and 2, the doubly folded parallel plate combiner used in the invention has a concave main reflector, indicated by reference numeral 10 and a convex subreflector 12. When the device operates as a divider, radio-frequency (rf) energy is input to the combiner through a feed horn 14 centrally located with respect to the main reflector 10, as viewed in the top view of FIG. 1, but displaced "below" the main reflector, as best shown in FIG. 2. Input energy passes below the main reflector 10, as indicated by the path 16, and impinges on the subreflector 12. Energy is reflected from the subreflector 12 back to the main reflector 10, along the path indicated at 18, and is then reflected by the main reflector along the path indicated at 20 and out of the device. As seen in elevation, the input energy follows a serpentine, doubly folded path through the device, which comprises three connected planar waveguide sections folded over each other. Viewed from above, as in FIG. 1, energy from the feed horn 14 diverges toward the subreflector 12, and continues diverging toward the main reflector 10, before being reflected out of the device in a beam that is spread uniformly in the plane of the device.

The doubly-folded configuration of the combiner achieves an aperture enlargement in one dimension without any loss of efficiency or uniformity that might be caused by shadowing of the beam by the subreflector 12 or the feed horn 14. It can be seen from FIG. 2 that the path 20 is not obstructed by the subreflector 12, and the path 16 between the subreflector 12 and the reflector 10 is not obstructed by the feed horn 14. In addition, the doubly folded configuration achieves a desired degree of divergence in a relatively compact device. It will also be apparent that the device operates as a combiner if the paths 16, 18 and 20 are considered to be traversed in the reverse direction, toward the feed horn 14.

Figure 3B:
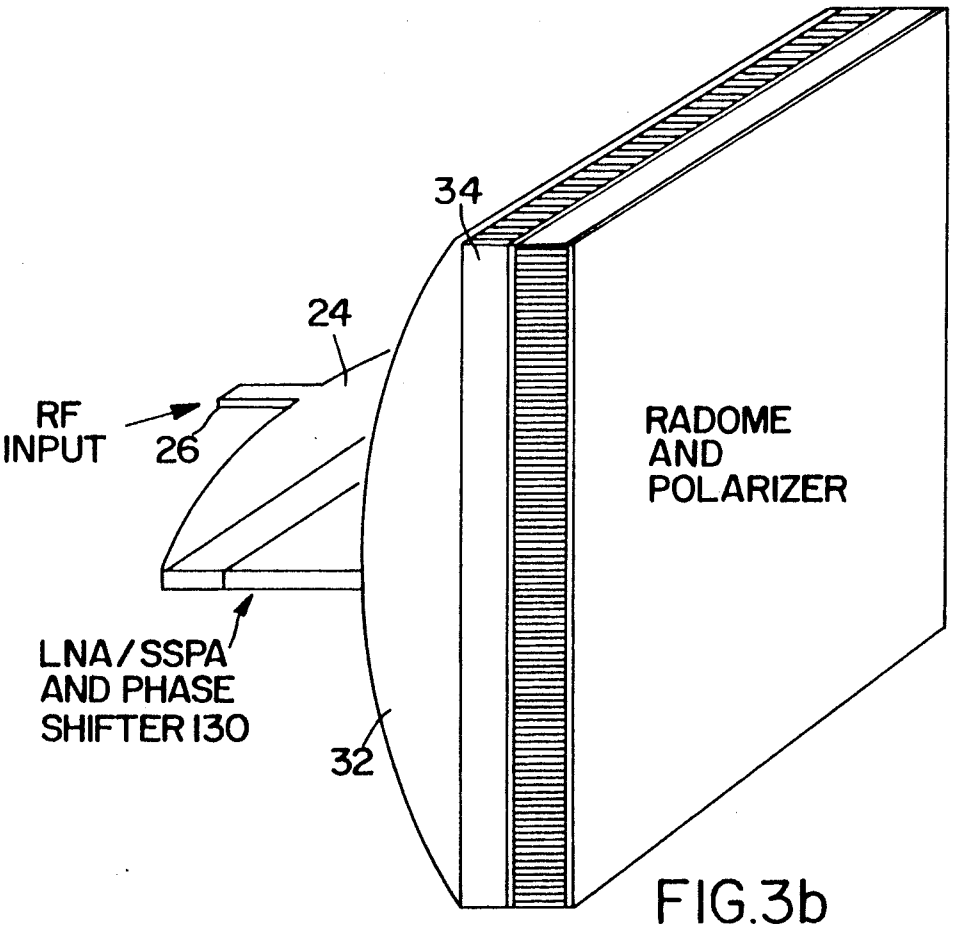
FIGS. 3*a* and 3*b* are diagrammatic views of a two-dimensional phased array beamforming network in accordance with the invention.
Figure 3A:
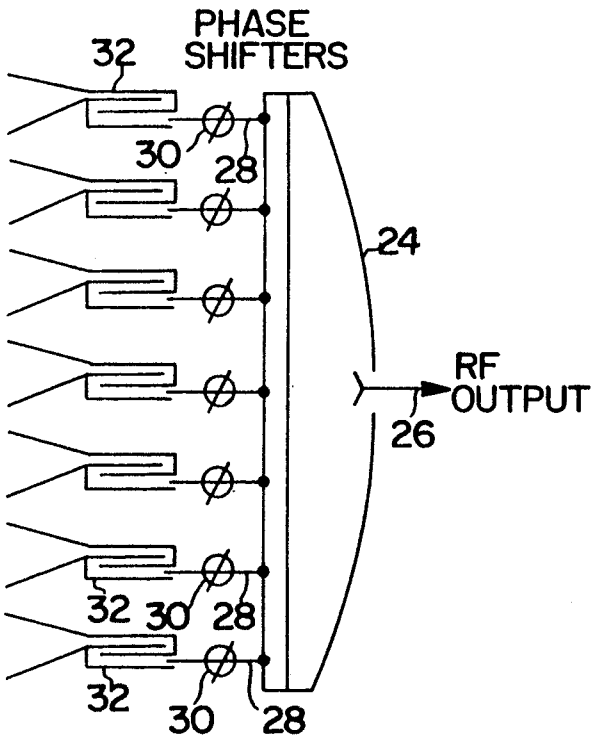

FIGS. 3*a* and 3*b* show a basic beamforming network using parallel plate combiners in accordance with the invention. The network includes a first power combiner 24, to which rf energy is applied (if the device is a transmitter), as indicated at 26. Output from the combiner 24 is spread over an enlarged aperture and provides multiple rf signals, as indicated at 28, each of which is subject to processing by a phase shifter 30 and is then input to a separate parallel plate combiner 32. The combiners 32 provide an enlarged aperture in a direction perpendicular to the direction of enlargement of the aperture of the first combiner 24. The rf outputs from the combiners 32 may be further processed by a polarizer 34. The overall configuration provides a composite beam that may be scanned in one plane, parallel to the plane of the first combiner 24, by controlling the phase shifters 30.

Figure 4:
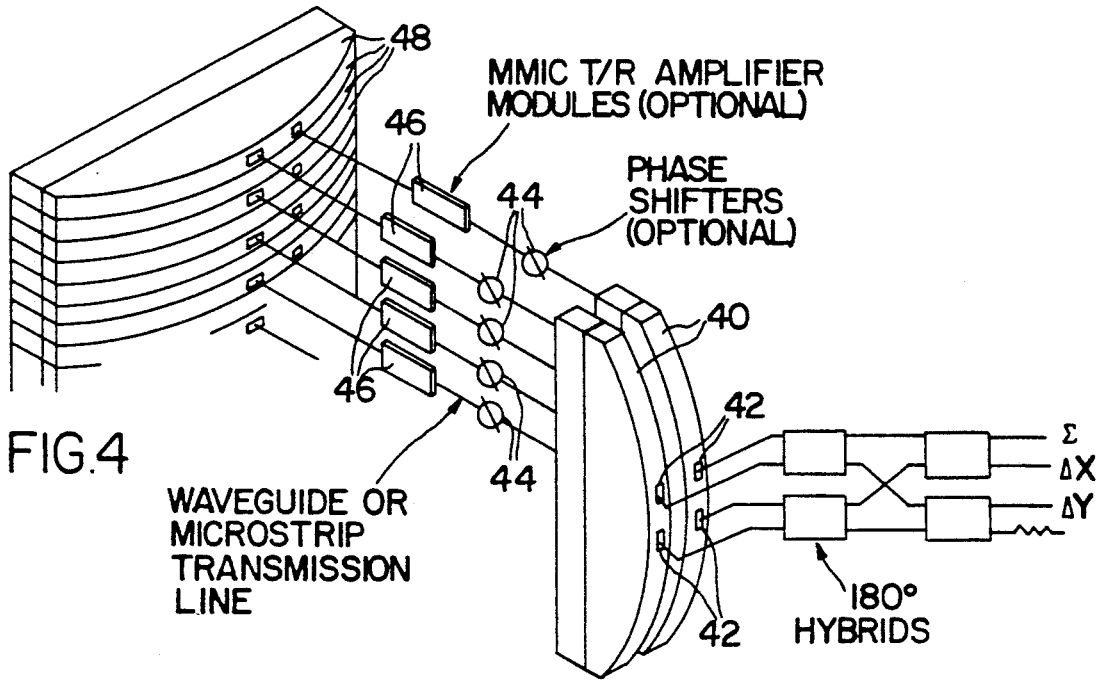
FIG. 4 is a diagrammatic view of a monopulse beamforming network using parallel plate power combiners.

FIG. 4 depicts how the modular principles of the invention may be applied to a monopulse beamforming network. The illustrated configuration includes a pair of parallel plate combiners 40, each of which has two rf feeds, indicated at 42. The combiners 40 have enlarged output apertures in the vertical direction, as viewed in the figure. Multiple outputs derived from the combiners 40 are transmitted through individual phase shifters 44; then possibly through transmit/receive amplifier modules 46. Each corresponding pair of amplified outputs, one from each of the combiners 40 is applied to a pair of input horns on one of a stack of additional parallel plate combiners 48, arrayed perpendicularly with respect to the two combiners 40. Thus the stack of combiners 48 produces a two-dimensionally expanded-aperture output beam that can be scanned in elevational angle by appropriated adjustment of the phase shifters 44.

Figure 5:
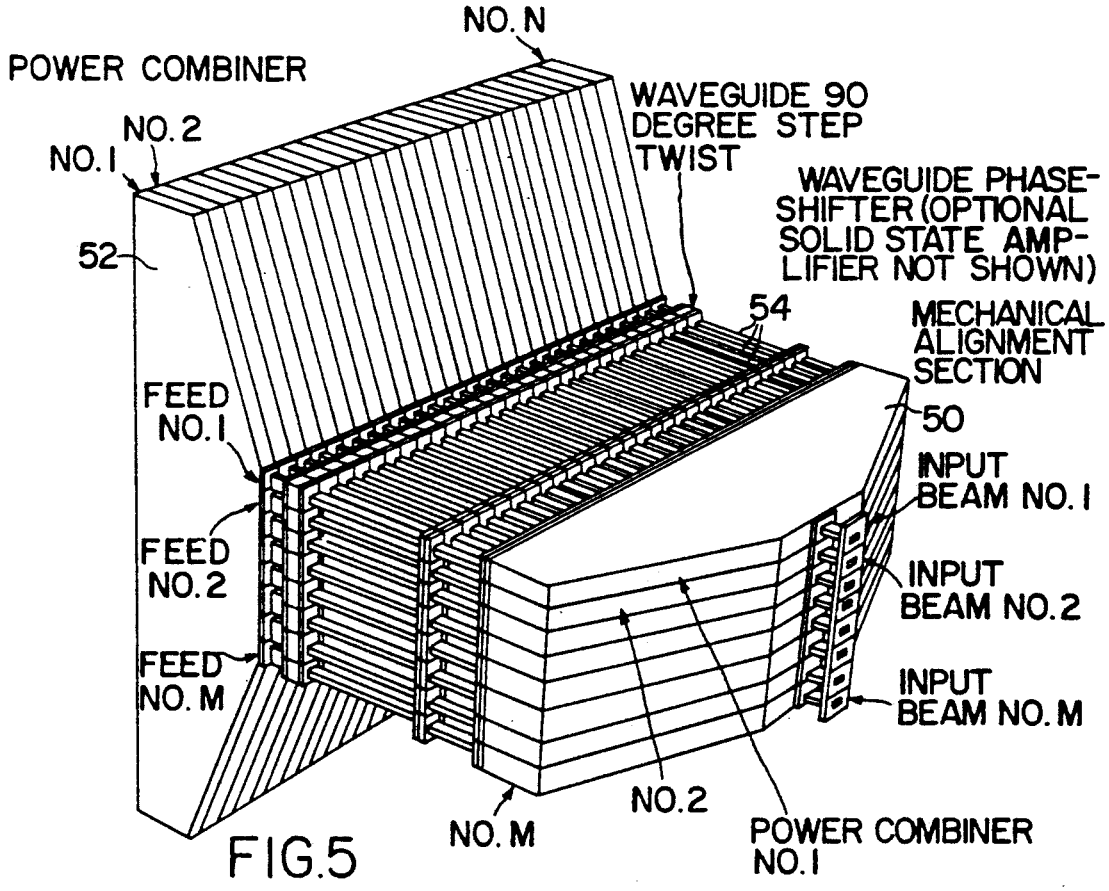
FIG. 5 is a diagrammatic view of a multiple beamforming network using parallel plate combiners.

FIG. 5 depicts a somewhat more complex beamforming network having a first stack of M power combiners 50 with their plates parallel to a horizontal plane, and a second stack of N power combiners 52 with their plates parallel to a vertical plane. M input beams are coupled to the first stack of combiners 50 and thereby expanded in the horizontal direction. Multiple outputs from each of the combiners 50 are coupled to waveguides 54 that include an amplification and phase-shifting function. This rectangular matrix of waveguides 54 is coupled to the second stack of combiners 52. Each of the combiners 52 has M input feeds, to accommodate a vertical column of M waveguides 54. Each of the M input beams applied to the first stack of combiners 50 is first spread in a horizontal plane by one of the combiners, and is later spread vertically by all of the second stack of combiners 52. The M beams can be separately steered in a horizontal or azimuth plane by appropriate adjustment of phase shifters included in the waveguides 54.

In accordance with an important aspect of the invention, three basic module types are used to construct a phased array antenna system that has reduced system complexity, improved performance, and relatively low cost. The three basic modules are a printed circuit antenna element, a microwave integrated circuit chip or module for amplification and phase shifting, and the doubly folded power combiner, for constructing an appropriate beamforming network.

Figure 6:
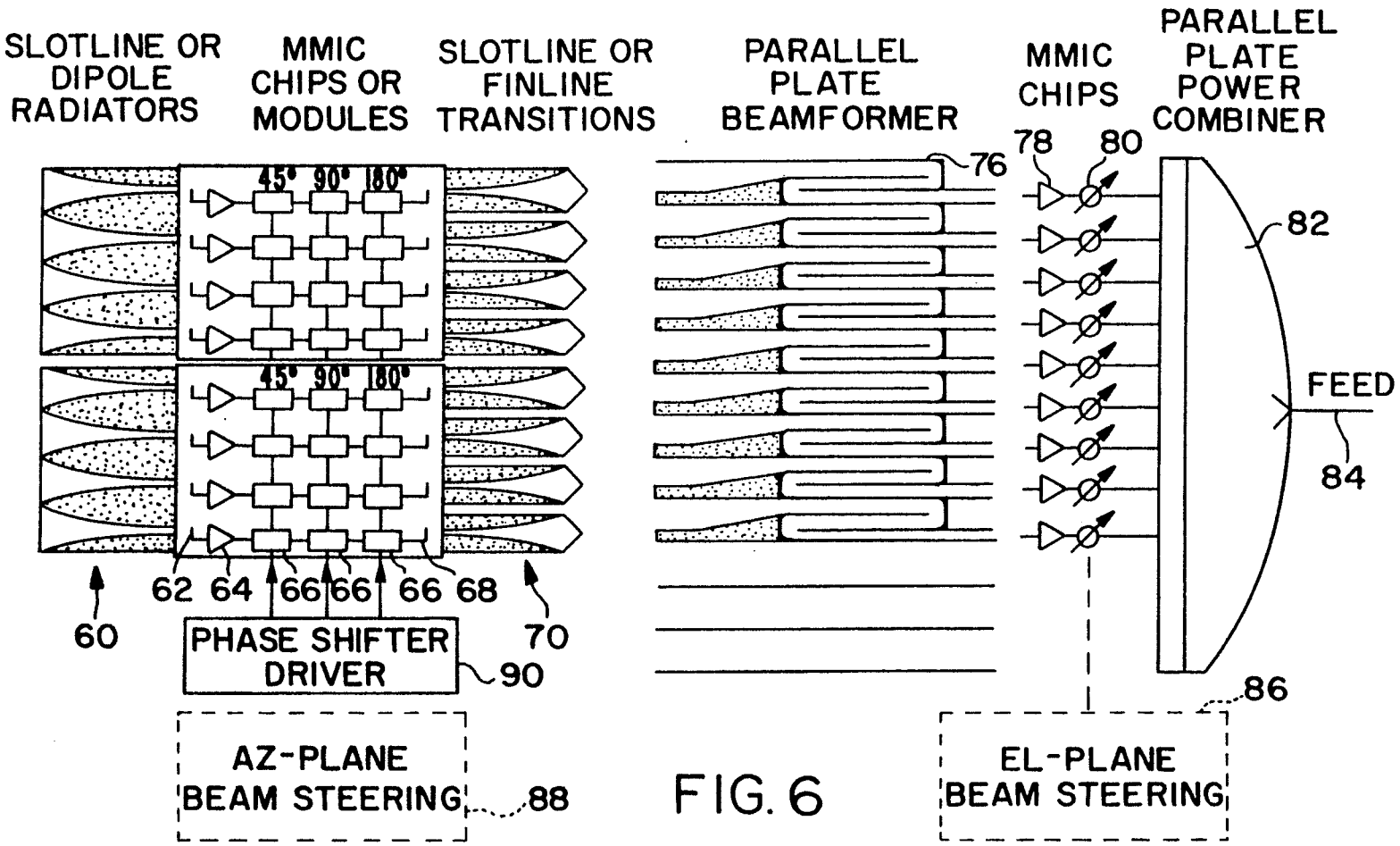
FIG. 6 is a diagrammatic view of a modular phased array antenna system in accordance with one aspect of the invention.
Figure 7A:
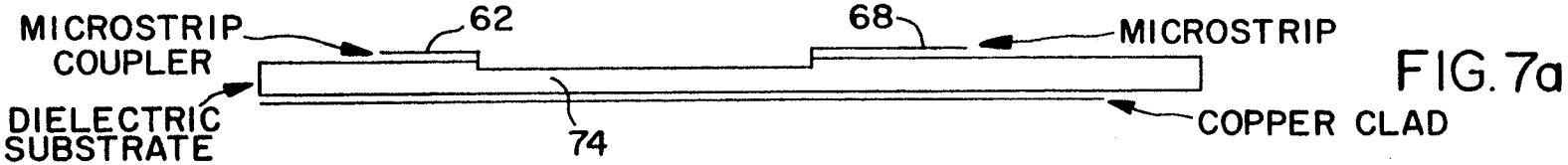
FIGS. 7*a* and 7*b* are elevation and plan top views, respectively, of a microwave integrated circuit module used in the antenna system of FIG. 6.
Figure 7B:
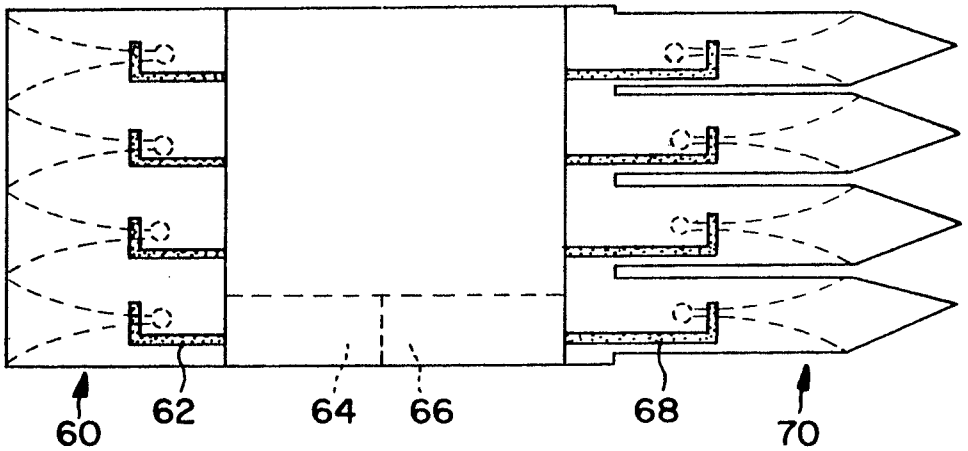
Figure 8:
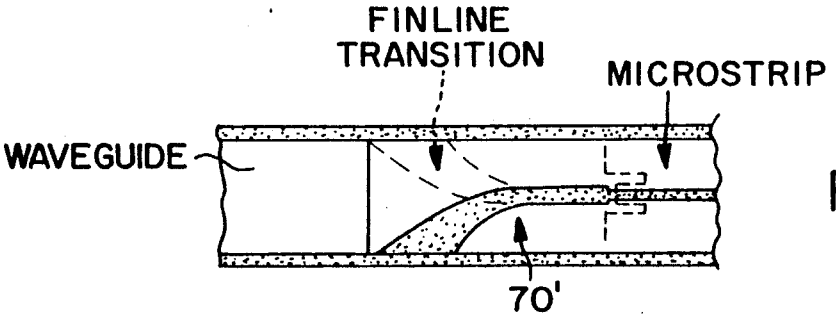
FIG. 8 is a top view of a waveguide-to-microstrip transition section for use as an alternate form of the transition shown in FIG. 7*b;*

FIG. 6 shows a general form of the phased array antenna system of the invention. The system includes an array of printed circuit antenna elements 60, one column of which is shown. The antenna elements may be formed as slotline or dipole radiators. Each antenna element feeds energy into a microstrip section, through a microstrip coupler, best shown at 62 in FIG. *7b*. The microstrip coupler, in receiver operation, couples energy into an amplifier chip or module 64, the output of which is coupled into a phase shifter module 66. Also included in the same microwave circuit module, but not specifically shown, are dc bias circuitry and control driver electronics associated with phase shifting. As shown in FIG. 6, the phase shifting circuit includes three separate phase shifting units, for changing the phase of the incident signal by 45°, 90° and 180°, respectively. When appropriate combinations of these three units are activated, phase shifts from 0° to 315°, in increments of 45°, can be achieved. The output energy from each phase shifter 66 is coupled, through another microstrip coupler 68, to a transition section 70, which effects a smooth transition from the microstrip coupler 68 to some form of waveguide, shown only diagrammatically at 72 in FIG. 6. The transition section shown in FIGS. *7a* and *7b* is a flared slotline. An alternative is the finline transition 70' of FIG. 8.

In the illustrative form of the invention shown in FIG. 6, the printed circuit antenna elements 60, amplifier modules 64, phase-shifting circuits 66 and slotline-to-waveguide transition sections 70 are all formed, in groups of four feeds each, on a common dielectric substrate 74 (FIG. *7a*). FIG. 6 shows two such groups of four antenna elements and associated microwave processing circuitry. The input and output microstrip-to-slotline couplers are etched onto the substrate during monolithic processing of the microwave circuit modules. The substrate, which may be of gallium arsenide, is bonded to metallized areas of the antenna elements, with the input and output couplers properly aligned to the slotline or dipole antenna radiators. This approach provides a stiff mechanical support for the microwave circuit chips, which tend to be brittle.

The waveguide side of the transition sections 70 feed into enlarged apertures of a stack of doubly folded power combiners 76 oriented in horizontal planes as shown in the figure. Other columns of antenna elements 60, not shown, with associated other amplifier modules 64 and phase shifter modules 66, produce additional waveguide inputs for the combiners 76. Thus, each of the combiners 76 receives input energy (in receiver operation) from a horizontally arrayed row of antenna elements 60. The outputs from the combiners 76 may be further separately amplified, as indicated at 78, phase shifted, as indicated at 80, and finally input to an additional single power combiner 82 oriented in a vertical plane to receive and combine all the outputs from the stack of horizontally oriented combiners 76. The combined antenna system signal, in receiver operation, emerges on line 84.

Beam steering in the elevation plane is effected by adjustment of the phase shifters 80, as indicated at 86. Beam steering in the azimuth plane is effected, as indicated at 88, using a phase shift driver 90 to control the phase shift units 66. For azimuth steering, all of the 45° units associated with a column of antenna elements 60 are ganged together, as are all of the 90° units and all of the 180° units. Thus the same phase shift is applied to all of the antenna elements in a single column.

This technique for phase shifting, and thereby steering the antenna array, is to be contrasted with the typical approach of conventional phased array antenna systems, wherein each phase shifter has an associated shift register, from which stored bits are strobed into a separate phase shift driver, which controls the phase shifting units in accordance with the bit values. For an antenna array of size $N \times M$ this requires $N \times M$ shift registers and phase shift drivers, and some relatively complex associated wiring. The phase-shifting technique of the invention requires only $N+M$ phase shifter driver units. For example, an antenna providing 40 dB, 60° half-cone scan coverage requires approximately 9,000 digital word shift registers and phase shifter drivers for a conventional scheme of phase shifting, but only about 300 phase shifter drivers using the principles of the present invention. This reduction in the complexity of beam steering control electronics, by a factor of about thirty in the example, has the related advantage that more space is provided for heat dissipation from the antenna system.

Figure 9:
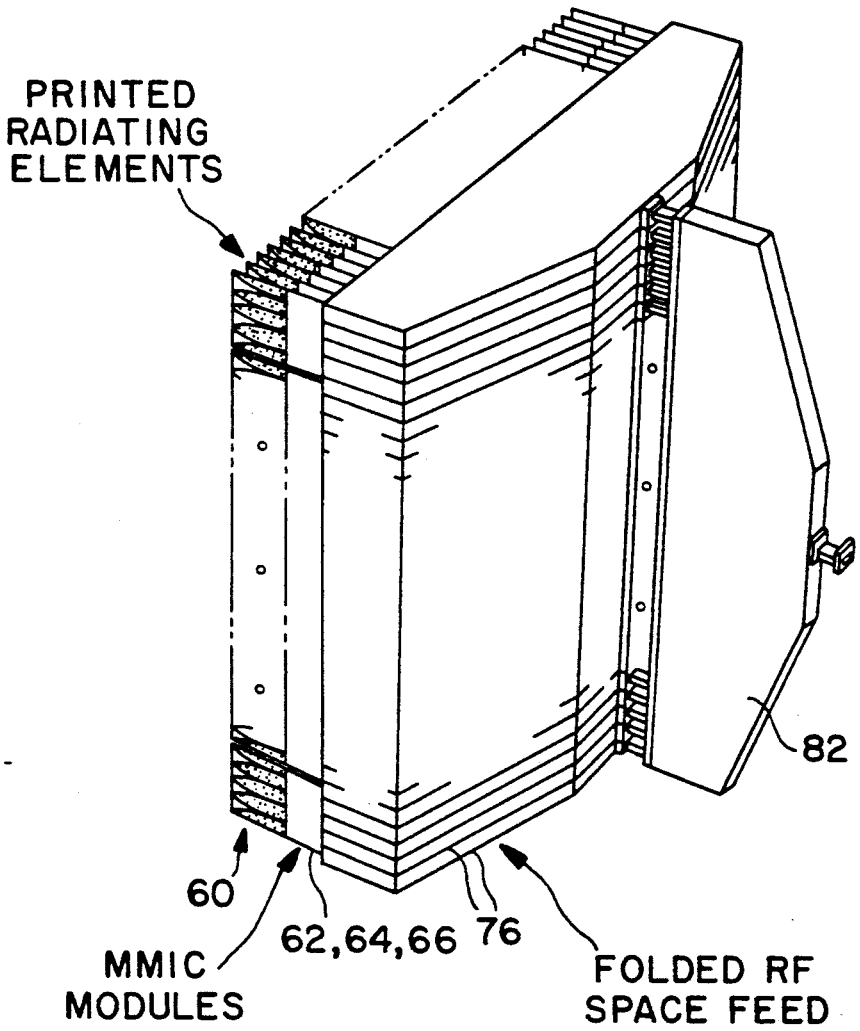
FIG. 9 is a simplified perspective view of an integrated phased array antenna system in accordance with the invention.

FIG. 9 is an integrated phased array antenna system of the type shown diagrammatically in FIG. 6. The array includes the printed circuit antennas 60, the integrated modules including amplifiers 62, phase shifters 64 and transition sections 70, the stack of horizontally oriented combiners 76, and the single vertically oriented combiner 82. Advantages of this integrated configuration include independent elevations and azimuth beam steering, with a reduction in circuit complexity of at least twenty to one, low losses in the doubly folded feed network, enhanced reliability and performance, and ease of assembly and maintenance.

Figure 10:
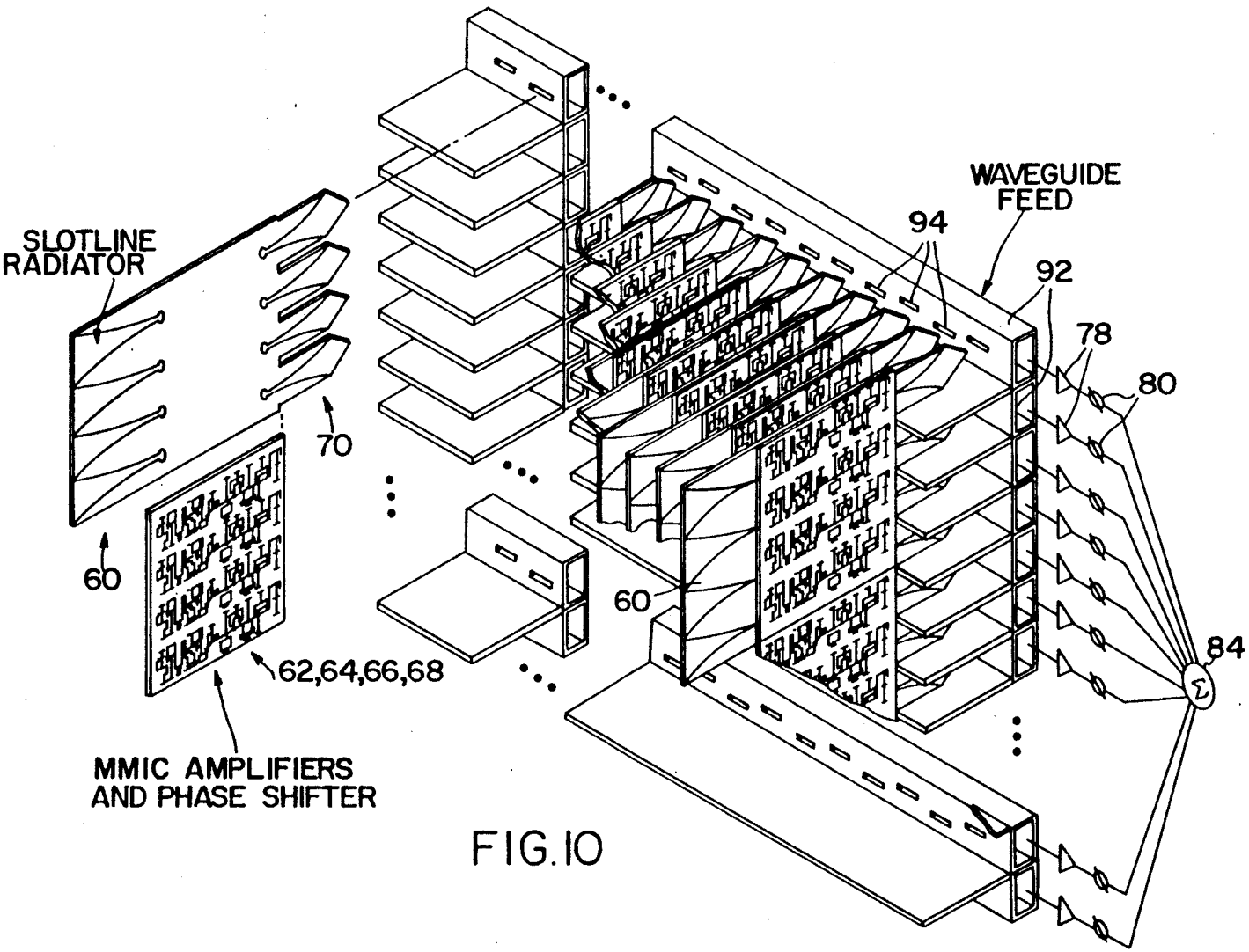
FIG. 10 is a simplified perspective view of a phased array antenna system in accordance with the invention, using a slot waveguide feed.

FIG. 10 is another embodiment of the invention, in which a different technique is used for combining power in each row of the array. As in the embodiment of FIG. 6, this configuration includes an array of printed circuit antenna elements 60, which feed into integrated modules containing amplifiers and phase shifters, and slotline-to-waveguide transition sections. However, instead of each row of transition sections feeding into parallel plate combiners, the rows in this embodiment feed into horizontally oriented rectangular waveguides 92, through slots 94 in a waveguide wall. Each rectangular waveguide 92 feeds through an amplifier 78 an phase shifter 80 and thence to a single combiner 84, shown only diagrammatically in this figure. The phase shifters 80 in this arrangement effect beam scanning in the elevational direction.

Figure 11B:
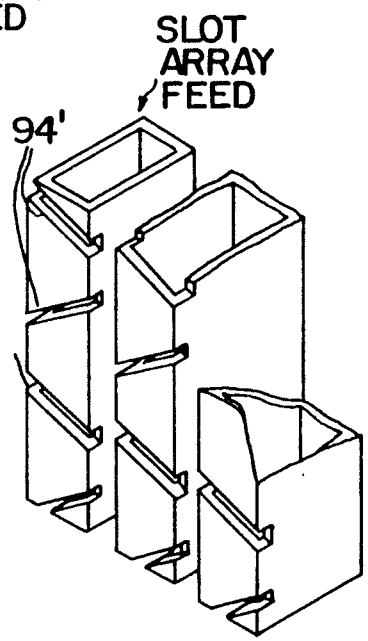
FIGS. 11A and 11B are simplified perspective views similar to FIG. 10, but using an edge slot array feed.
Figure 11A:
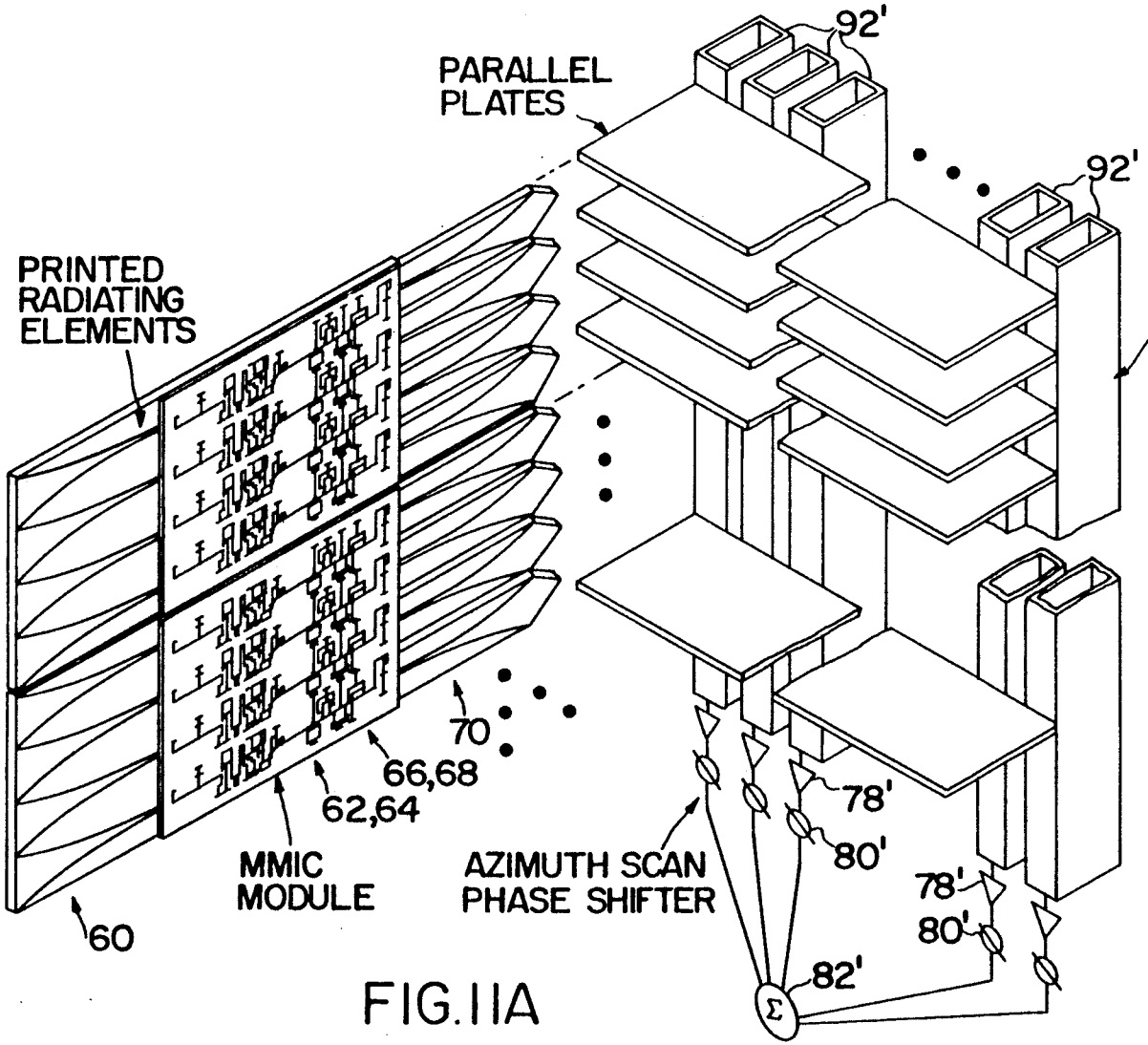

FIG. 11 is yet another embodiment of the invention, similar to the version depicted in FIG. 10, but with vertically oriented rectangular waveguides, indicated at 92'. These waveguides 92' have slots 94' through which energy from the transition sections 70 are coupled. Because the waveguides 92' are vertically oriented, each waveguide collects and combines energy from a single column of antenna elements. Each waveguide 92' feeds through a separated amplifier 78' and phase shifter 80' to a single combiner 82', which is necessarily vertically oriented. The phase shifters 80' in this arrangement effect beam scanning in the azimuth direction.

It will be appreciated from the foregoing that the present invention represents a significant advance in the field of phased array antenna systems. In particular, the invention provides a power combiner or divider that facilitates various beamforming configurations. Further, these beamforming configurations can be usefully combined with printed circuit antenna elements and with microwave integrated circuit modules, to form various embodiments of a complete phased array antenna system that performs better than conventional antenna arrays, but is much less complex and less costly. It will also be appreciated that, although several embodiments of the invention have been described in detail for purposes of illustration, various modifications may be made without departing from the spirit and scope of the invention. Accordingly, the invention is not to be limited except as by the appended claims.

I claim:

1. A beam forming network for use in a phased array antenna system, the beam forming network comprising:

a doubly folded parallel plate beam forming device, having a first port for a radio-frequency (rf) signal that has been received or is to be transmitted, and having a second port with an aperture that is elongated along a first direction;

a stack of identical doubly folded parallel plate beam forming devices, each of which has a second port that is elongated along a second direction approximately perpendicular to the first direction, whereby the combined second ports of the stack receive or transmit a composite beam that is enlarged in cross section in two perpendicular directions; and wherein each doubly folded parallel plate beam forming device has a feed horn at its first port, a main reflector presenting an enlarged output aperture to the second port, and a subreflector for reflecting a transmitted beam from the feed horn to the main reflector, and for reflecting a received beam from the main reflector to the feed horn.

2. A beam forming network for use in a phased array antenna system, the beam forming network comprising:

a doubly folded parallel plate beam divider, for inputting a radio-frequency (rf) signal to be transmitted, and outputting the rf signal through an aperture that is elongated along a first direction; and a stack of identical doubly folded parallel plate beam dividers, each of which receives an input signal from the first beam divider and outputs rf signals through apertures that are enlarged along a second direction approximately perpendicular to the first direction, whereby the combined outputs of the stack of beam dividers form a composite output beam that is enlarged in cross section in two perpendicular directions;

wherein each doubly folded parallel plate beam divider has a feed horn at its first port, a main reflector presenting an enlarged output aperture to the second port, and a subreflector for reflecting and enlarging a transmitted beam from the feed horn to the main reflector.

3. A phased array antenna system, comprising:

a doubly folded parallel plate beam forming device, having a first port for a radio-frequency (rf) signal that has been received or is to be transmitted, and has a second port with an aperture that is elongated along a first direction;

a stack of identical doubly folded parallel plate beam forming devices, each of which has a first port coupled to the second port of the first beam forming device, and has a second port that is enlarged along a second direction approximately perpendicular to the first direction;

a plurality of phase shifting circuits coupled to the first ports of the stack of beam forming devices, for varying the phase of rf signals transmitted through the first ports of the stack;

a plurality of microwave modules arranged in an array with multiple rows and columns, and coupled to the second ports of the stack of beam forming devices, wherein each row of modules is coupled to one of the second ports, and wherein each module includes a phase shifting circuit;

an array of antenna elements, each coupled to one of the modules, to receive or transmit a composite beam;

and wherein the plurality of phase shifting circuits coupled to the first ports of the stack of beam forming devices are adjustable to steer the composite beam in a plane parallel to the first direction, and the phase shifting circuits included in the transmit/receive modules are adjustable to steer the composite beam in a plane parallel to the second direction.

4. A phased array antenna system as defined in claim 3, wherein:

each of the microwave modules includes an rf amplifier, first coupling means, for coupling a corresponding antenna element to the rf amplifier, and second coupling means, for coupling the phase shift circuit to the second port of one of the stack of beam forming devices.

5. A phased array antenna system as defined in claim 4, wherein:

the phase shifting circuit included in each module includes multiple phase shifting units, each of which can be selectively enabled to interpose a phase shift of a fixed amount.

6. A phased array antenna system as defined in claim 4, wherein:

the second coupling means includes a microwave transition section for converting from a slotline configuration to a waveguide configuration and vice versa.

7. A phased array antenna system as defined in claim 6, wherein:

the microwave transition section includes a tapered slotline transition.

8. A phased array antenna system as defined in claim 6, wherein the microwave transition section includes a finline transition.

9. A phased array antenna system as defined in claim 3, wherein:

the components of the system are integrated into a single package.

10. A phased array antenna system as defined in claim 3, wherein each of the doubly folded parallel plate beam forming devices includes:

a feed horn coupled to the first port;

a convex subreflector;

a concave main reflector;

a first planar waveguide section extending from the feed horn to the subreflector and presenting a diverging path as viewed from the feed horn;

a second planar waveguide section extending from the subreflector to the main reflector, overlaying the first planar waveguide section, and presenting a further diverging and unobstructed path as viewed from the subreflector; and a third planar waveguide section extending from the main reflector to the second port, overlaying the second planar waveguide section, and providing an unobstructed path to the support port, which has an aperture expanded in a direction parallel to the plane of the beam forming device.

11. A beam forming network for use in a phased array antenna system, the beam forming network comprising:

a doubly folded parallel plate beam forming device, having a first port for a radio frequency (rf) signal that has been received or is to be transmitted, and having a second port with an aperture that is elongated along a first direction;

a stack of identical doubly folded parallel plate beam forming devices, each of which has a first port coupled to the second port of the first beam forming device, and has a second port that is enlarged along a second direction approximately perpendicular to the first direction, whereby the combined second ports of the stack receive or transmit a composite beam that is enlarged in cross section in two perpendicular directions; and a plurality of phase shifting circuits, each associated with one of the stack of beam forming devices, for scanning the composite beam in a plane parallel to the first direction.

12. A beam forming network for use in a phased array antenna system, the beam forming network comprising:

a doubly folded parallel plate beam divider, for inputting a radio-frequency (rf) signal to be transmitted, and outputting the rf signal through an aperture that is elongated along a first direction;

a stack of identical doubly folded parallel plate beam dividers, each of which receives an input signal from the first beam divider, and outputs rf signals through apertures that are enlarged along a second direction approximately perpendicular to the first direction, whereby the combined outputs of the stack of beam dividers form a composite output beam that is enlarged in cross section in two perpendicular directions; and a plurality of phase shifting circuits, each associated with one of the stack of beam dividers, for scanning the composite output beam in a plane parallel to the first direction.

13. A beam forming network for use in a phased array antenna system, the beam forming network comprising:

a doubly folded parallel plate beam divider, for inputting a radio-frequency (rf) signal to be transmitted, and outputting the rf signal through an aperture that is elongated along a first direction;

a stack of identical doubly folded parallel plate beam dividers, each of which receives an input signal from the first beam divider, and outputs rf signals through apertures that are enlarged along a second direction approximately perpendicular to the first direction, whereby the combined outputs of the stack of beam dividers form a composite output beam that is enlarged in cross section in two perpendicular directions; and at least one additional power divider aligned in the first direction, wherein both of the dividers aligned in the first direction have two rf input feeds;

and wherein each of the stack of dividers aligned in the second direction has two rf inputs;

and wherein the outputs of one of the dividers aligned in the first direction are coupled to a first rf input of each of the dividers aligned in the second direction, and the outputs of the other of the dividers aligned in the first direction are coupled to a second rf input of each of the dividers aligned in the second direction;

and whereby at least two composite output beams are output from the stack of dividers aligned in the second direction.

* * * * *